United States Patent [19]

Sorli et al.

[11] Patent Number: 4,556,306

[45] Date of Patent: Dec. 3, 1985

[54] FILM PROCESSING APPARATUS INCLUDING A VACUUM PICKUP HEAD FOR A FILM PROCESSING FLUID CONTAINER

[75] Inventors: Duncan C. Sorli, Chelmsford, Mass.; John H. Keightley, Richmond, Canada

[73] Assignee: Polaroid Corporation, Cambridge, Mass.

[21] Appl. No.: 664,799

[22] Filed: Oct. 25, 1984

[51] Int. Cl.[4] ..... G03D 9/02

[52] U.S. Cl. ..... 354/304; 354/86

[58] Field of Search ..... 354/83, 84, 85, 86, 354/87, 88, 304

[56] References Cited

U.S. PATENT DOCUMENTS

| | | | |
|---|---|---|---|
| 2,435,718 | 2/1948 | Land | 354/304 |
| 3,396,650 | 8/1968 | Rubinstein et al. | 354/304 |
| 4,514,069 | 4/1985 | Kinsman et al. | 354/304 |

*Primary Examiner*—A. A. Mathews

*Attorney, Agent, or Firm*—Edward S. Roman

[57] ABSTRACT

Apparatus are provided for automatically retrieving a rupturable film processing fluid container from a supply tray and thereafter depositing the retrieved container on one of a pair of converging positive and negative film sheets prior to the processing of the film sheets between a pair of pressure-applying rollers operable to rupture the fluid container and spread the processing fluid between the positive and negative film sheets.

5 Claims, 6 Drawing Figures

FILM PROCESSING APPARATUS INCLUDING A VACUUM PICKUP HEAD FOR A FILM PROCESSING FLUID CONTAINER

BACKGROUND OF THE INVENTION

1. Field of the Invention

This invention relates generally to an automatic film processing fluid container picker assembly and, more particularly, to a picker assembly for automatically retrieving film processing fluid containers from a storage tray for ultimate deposition between a pair of converging positive and negative film sheets prior to film processing.

2. Description of the Prior Art

Self-developing cameras of a type disclosed in U.S. Pat. No. 2,435,718, entitled "Photographic Process and Apparatus for Subjecting a Photographic Film to a Processing Fluid", by E. H. Land, issued Feb. 10, 1948, are now well known in the art. Such early self-developing photographic cameras did not utilize integral self-developing film units as now utilized in Polaroid's SX-70 and 600 model cameras but instead exposed a negative film sheet unwound from a negative film sheet roll. The exposed negative film sheet was thereafter fed into the bite of a pair of pressure-applying processing rollers. At the same time, a positive film sheet unwound from a positive film sheet roll was simultaneously fed into the bite of the processing rollers in superposition with respect to the exposed negative film sheet and a rupturable or frangible container of film processing fluid, consisting substantially of a viscous fluid, was deposited between the negative and positive film sheets at the bite of the processing rollers. The processing rollers thereafter operated to rupture the film processing fluid container and squeeze the processing fluid out of the container so as to spread the processing fluid between the superimposed positive and negative film sheets. The aforementioned Land patent shows the film processing fluid containers stacked in a spring-loaded magazine from which the containers are selectively ejected by means of a reciprocating plunger activated by a suitable mechanism in timed relationship to the rotation of the processing rollers and the activation of the shutter release mechanism. Although self-developing cameras for the most part today comprise integral film units of the aforementioned type wherein the pod of film processing fluid is integrally disposed within the film unit, a number of film processors are still commercially available in which the processing fluid must be manually deposited between the positive and negative film sheets as the film sheets converge upon the film processing rollers.

Therefore, it is a primary object of this invention to provide a picker assembly for automatically retrieving a film processing fluid container from a supply tray and thereafter depositing the retrieved container on one of a pair of converging positive and negative film sheets prior to processing.

Other objects of the invention will be in part obvious and will in part appear hereinafter. The invention accordingly comprises a mechanism and system possessing the construction, combination of elements and arrangement of parts which are exemplified in the following detailed disclosure.

SUMMARY OF THE INVENTION

The apparatus of this invention operates to automatically retrieve a film processing fluid container from a supply tray and to thereafter deposit the retrieved container on one of a pair of converging positive and negative film sheets prior to processing. The retrieving and loading apparatus comprises a carriage and at least one vacuum pickup head extending laterally outward from the carriage. Means are provided for moving the carriage in a generally horizontal direction longitudinally through the supply tray so that the pickup head may be moved into engagement with a respective one of the film processing fluid containers in the supply tray. The pickup head is thereafter raised in a generally vertical direction transversely of the supply tray so as to retrieve the fluid container so engaged. The carriage is thereafter moved in a generally horizontal direction longitudinally above the supply tray so that the retrieved film processing fluid container may be moved aside the supply tray to a location above one of the film sheets. The film processing container is thereafter lowered by the vacuum pickup head and deposited on one of the converging positive and negative film sheets prior to processing. The supply tray is configured to retain the film processing fluid containers in a substantially vertical orientation wherein the fluid containers substantially maintain the vertical orientation during the transverse and longitudinal movements. The vacuum pickup heads are pivotally connected with respect to the carriage so as to be rotatable from a substantially vertical orientation to a position generally parallel to the film sheet upon which the processing fluid container is deposited. There are further provided cams operatively associated with the vacuum heads for shifting the vertical orientation of vaccum heads to the aforementioned parallel orientation during this horizontal movement thereby allowing the fluid containers to be deposited upon the film sheet in a generally parallel orientation thereto.

DESCRIPTION OF THE DRAWINGS

The novel features that are considered characteristic of the invention are set forth with particularity in the appended claims. The invention itself, however, both as to its organization and its method of operation, together with other objects and advantages thereof will be best understood from the following description of the illustrated embodiment when read in connection with the accompanying drawings wherein:

DESCRIPTION OF THE PREFERRED EMBODIMENT

Figure 1:
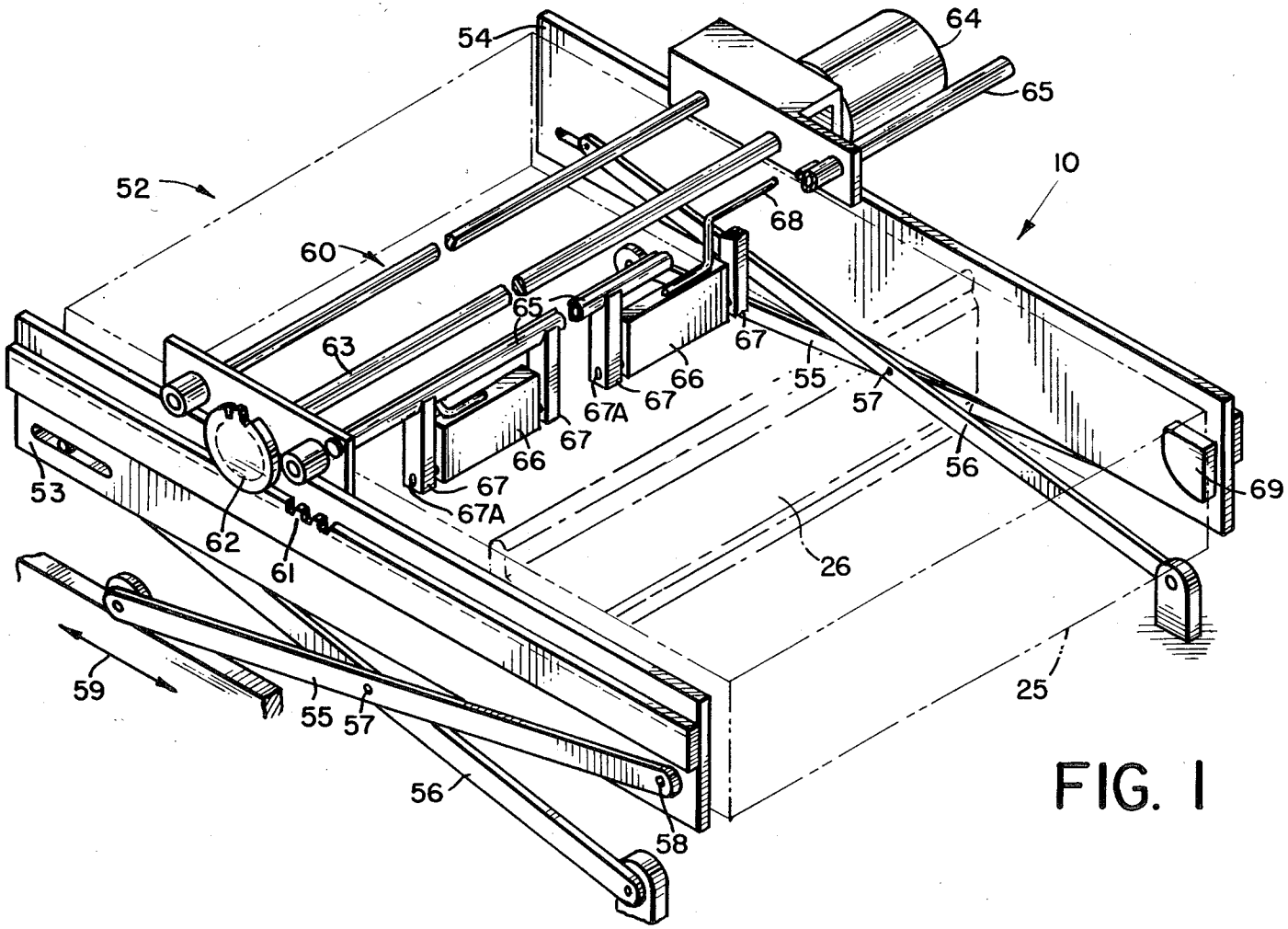
FIG. 1 is a perspective view of the apparatus of this invention for automatically retrieving a film processing fluid container from a supply tray and thereafter depositing the retrieved container in one of a pair of converging positive and negative film sheets prior to processing.

Referring now to FIG. 1 there is shown the film processing fluid container picker assembly 10 of this invention stationed relative to a supply tray 25 containing a plurality of parallel spaced apart film processing containers one of which is shown at 26 in phantom lines. The picker assembly 10 comprises respective parallel side plates 53 and 54 which may be raised (or lowered) in generally vertical directions transversely of the supply tray 25 by respective support rods 55 and 56 connected in a "scissors" arrangement. The rods are pivoted to each other, as at 57, and to the side plates, as at 58. It will be understood that the pivoted rods 55, 56 may be actuated in a direction indicated by the arrows 59 to raise or lower the side plates 53, 54 in a generally vertical direction transversely of the supply tray 25. A carriage 60 is mounted on the side plates for movement in a generally horizontal direction longitudinally of the side plates 53 and 54 and hence of the supply tray 25. Each of the side plates 53, 54 has a top edge with a rack 61 formed thereon. The rack cooperates with a pinion 62 on a shaft 63 on the carriage 60, and the shaft 63 is driven by a suitable motor 64. Accordingly, it will be appreciated that the carriage 60 can be moved in a generally horizontal direction longitudinally of the side plates 53, 54 (and hence the supply tray 25) by means of the motor 64, shaft 63, pinion 62 and rack 61 on the respective side plates 53 and 54. The carriage 60 is also provided with a vacuum tube 65 connected to a suitable source of vacuum (not shown), and a pair of vacuum pickup heads 66 are mounted on the carriage 60. Preferably, the vacuum tube 65 extends through two pairs of spaced apart bars 67 depending downwardly therefrom, and each vacuum pickup head 66 is pivotally supported, as at 67*a*, between the bars 67.

Figure 2:
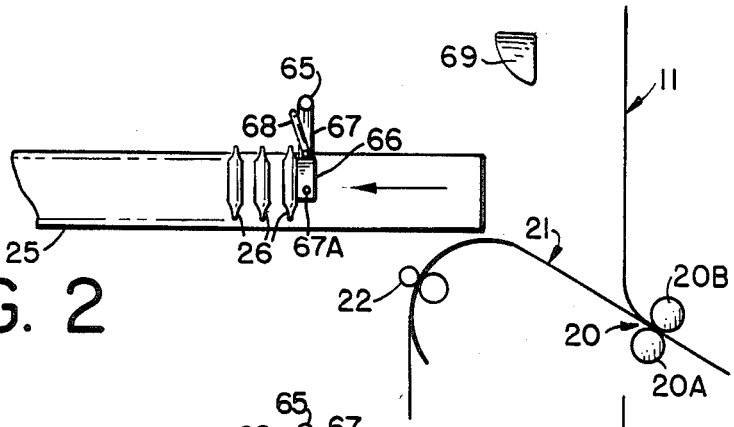
FIGS. 2 through 6, respectively, are schematic side elevations of the picker assembly of FIG. 1, illustrating in sequence the manner in which a film processing fluid container is retrieved from the supply tray and thereafter deposited on one of a pair of converging positive and negative film sheets prior to processing.

Operation of the picker assembly 10 of this invention may proceed as follows in accordance with FIGS. 2 through 6 wherein the film processing fluid containers 26 are preferably arranged in a substantially vertical orientation within the supply tray 25. As shown in FIG. 2, the carriage 60 is in a lowered position and driven backward in a generally horizontal direction longitudinally through the supply tray 25 by the coaction of the motor 64, shaft 63, pinion 62 and rack 61 on the side plates 53 and 54 so that the vacuum pickup head (or heads) 66 engage the next available film processing fluid container 26 in the supply tray 25. As will be readily understood, those parts of the supply tray 25 (not shown) which operate to hold the processing containers 26 in their spaced apart vertical orientation in the aforementioned manner are configured so as not to obstruct the previously described backward longitudinal movement of the pickup heads 66 through the supply tray 25.

Figure 3:
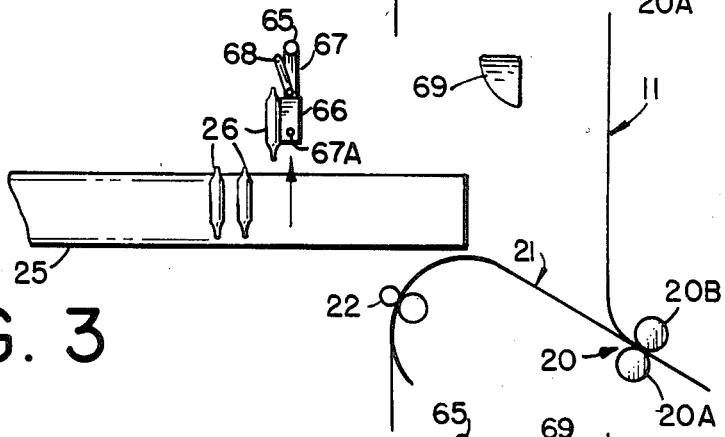
Figure 4:
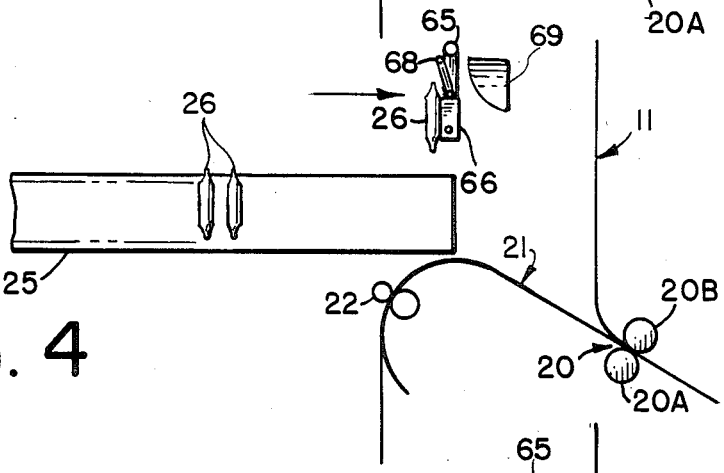
Figure 5:
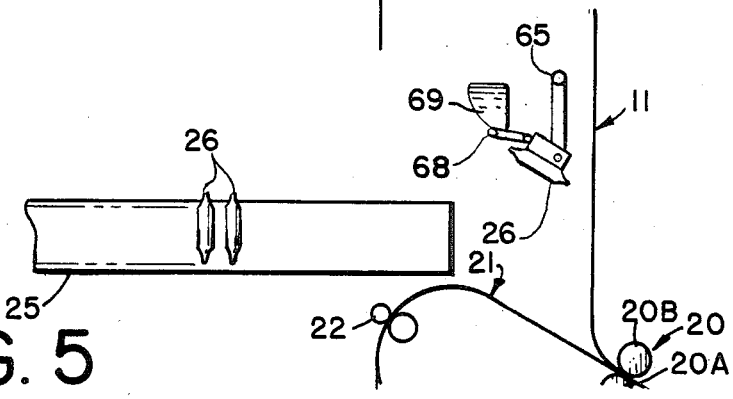
Figure 6:
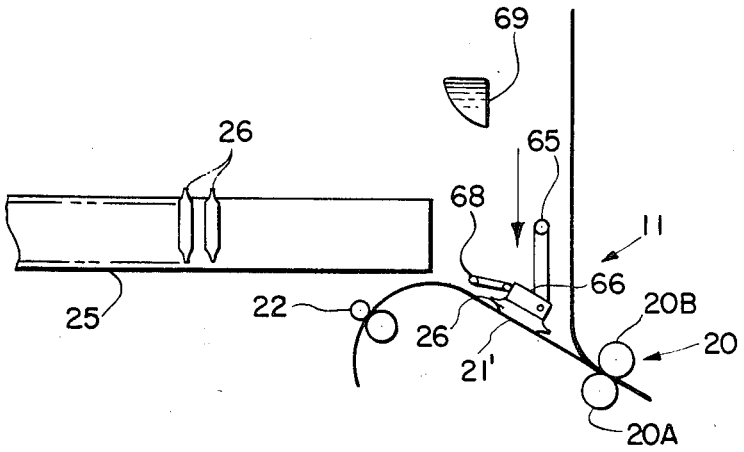

A vacuum is then applied via the vacuum tube 65 so that the vacuum pickup head 66 can engage and retain the adjacent film processing fluid container 26. The selected container 26 is thereafter retrieved from the storage tray 25 by raising the carriage 60 in a generally vertical direction transversely of the supply tray by the coaction of the pivoted support rods 55 and 56 as shown in FIG. 3. The carriage 60 is thereafter moved in a generally horizontal direction longitudinally of the side plates 53 and 54 and the supply tray 25 as shown in FIG. 4. Continued longitudinal movement of the carraige 60 in the aforementioned manner ultimately results in a pair of transversely projecting bent rods 68 carried by respective ones of the vacuum pickup heads 66 engaging respective stationary cams 69, mounted on the inner surfaces of the side plates 53 and 54 respectively. The cams 69 by engaging respectively the transversely projecting bent rods 68 operate to cause the respective vacuum pickup heads 66 to pivot about the axis 67*a*, as shown in FIG. 5, so as to move the retrieved film processing fluid container 26 into a substantially parallel orientation with respect to a positive film sheet 21. The carriage 60 is thereafter moved downward in a generally vertical direction so as to move the processing container 26 into position immediately adjacent the positive film sheet 21 as shown in FIG. 6. The vacuum is next removed and the retrieved film processing fluid container 26 is deposited onto the top of the positive film sheet at the location shown at 21′.

The positive film sheet is guided by a pair of feed rollers 22 to enter into the bite of a pair of film processing rollers as shown generally at 20 at an angle preferably in the order of 30° with respect to the horizontal. A negative film sheet 11 is also fed into the bite of the processing rollers 20 in superimposed relationship with respect to the positive film sheet 21 such that the processing container 26 slides into the line of convergence between the positive and negative film sheets and is thereafter carried through the bite of the processing rollers 20 so as to rupture the fluid container 26 and spread the film processing fluid between the positive and negative film sheets in the usual manner associated with self-developing films.

Thus, there is provided a picker assembly for automatically picking individual film processing fluid containers from a storage tray and thereafter depositing the retrieved fluid container onto one of a pair of converging film sheets whereby the fluid container is carried into the bite of a pair of processing rollers to facilitate the spread of the film processing fluid between the positive and negative film sheets.

Other embodiments of the invention, including additions, subtractions, deletions and other modifications of the preferred disclosed embodiments of the invention will be obvious to those skilled in the art and are within the scope of the following claims.

What is claimed is:

1. Apparatus for automatically retrieving a film processing fluid container from a supply tray and thereafter depositing the retrieved container on one of a pair of converging positive and negative film sheets prior to processing, said retrieving and loading apparatus comprising:

a carriage;

at least one vacuum pickup head extending laterally downward from said carriage; and means for moving said carriage in a generally horizontal direction longitudinally through said supply tray so that said pickup head may engage a respective one of the film processing fluid containers in the supply tray, said moving means then operating to raise said carriage and its accompanying fluid container so engaged from the supply tray in a vertical direction transversely of said supply tray, and to thereafter move said carriage in a generally horizontal direction longitudinally above said supply tray so that the retrieved film processing fluid container may be moved aside of the supply tray to a location above one of the film sheets, said moving means thereafter operating to lower the fluid container into the vicinity of the one film sheet of the pair of film sheets upon which the fluid container is to be deposited so that release of the retrieved film processing fluid container by said vacuum pickup head results in the deposition of the fluid container on one of the converging positive and negative film sheets prior to processing.

2. The apparatus of claim 1 wherein the supply tray is configured to retain the film processing fluid container in a substantially vertical orientation and wherein the fluid containers substantially maintain the vertical orientation during said transverse and longitudinal movements and wherein said vacuum pickup heads are pivotally connected with respect to said carriage so as to be rotatable from a substantially vertical orientation to a substantially parallel orientation with respect to the one film sheet of the pair of film sheets upon which the fluid container is to be deposited, said apparatus further comprising cam means operatively associated with said vacuum heads for shifting said vertical orientation of said vacuum heads to said parallel orientation during said horizontal movement.

3. The apparatus of claim 2 wherein the means for moving said carriage longitudinally of the supply tray comprises a pair of spaced apart parallel side plates, each of which includes a top edge with a rack formed thereon, a shaft extending between said side plates with pinions disposed at opposite ends thereof for respective engagement with said racks of said side plates, and a motor drivingly engaged to said shaft.

4. The apparatus of claim 3 wherein the means for moving said carriage vertically of the supply tray comprises support rods pivotally connected to each other and to said side plates, respectively, for raising and lowering said side plates and hence said carriage and pickup head vertically with respect to the supply tray.

5. The apparatus of claim 4 wherein each of said vacuum pickup heads has a transversely projecting rod for engaging said cam means, and wherein said cam means comprises respective cam members secured to the inside surfaces of respective ones of said side plates.

* * * * *